US008528508B2

(12) United States Patent
Meistrick et al.

(10) Patent No.: US 8,528,508 B2
(45) **Date of Patent: *Sep. 10, 2013**

(54) INDIVIDUAL ROCKER SHAFT AND PEDESTAL MOUNTED ENGINE BRAKE

(75) Inventors: Zdenek S. Meistrick, West Granby, CT (US); Robert S. Perkins, East Granby, CT (US); Neil E. Fuchs, New Hartford, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 441 days.

This patent is subject to a terminal disclaimer.

(21) Appl. No.: 12/754,346

(22) Filed: Apr. 5, 2010

(65) Prior Publication Data

US 2010/0251983 A1 Oct. 7, 2010

Related U.S. Application Data

(63) Continuation-in-part of application No. 12/611,297, filed on Nov. 3, 2009, now abandoned, which is a continuation-in-part of application No. 12/076,173, filed on Mar. 14, 2008, now Pat. No. 7,823,553.

(60) Provisional application No. 61/301,645, filed on Feb. 5, 2010, provisional application No. 60/895,318, filed on Mar. 16, 2007.

(51) Int. Cl.
*F01L 1/34* (2006.01)

(52) U.S. Cl.
USPC ..... 123/90.16

(58) Field of Classification Search
USPC ..... 123/90.12, 90.16
See application file for complete search history.

(56) References Cited

U.S. PATENT DOCUMENTS

| | | | | |
|---|---|---|---|---|
| 2,789,549 | A | 4/1957 | Brill | |
| 6,619,247 | B2 * | 9/2003 | Kobayashi | 123/90.15 |
| 2002/0174654 | A1 | 11/2002 | Yang | |
| 2005/0188966 | A1 | 9/2005 | Ruggiero et al. | |
| 2006/0005796 | A1 * | 1/2006 | Janak et al. | 123/90.16 |

OTHER PUBLICATIONS

Hope A. Bolton and Jay M. Larson, Valvetrain System Design and Materials, "A Chronology of Hydraulic Lash Compensation in the United States" by W.A. Dammers (Eaton Corporation, Marshall, Michigan), International Symposium on Valvetrain System Design and Materials, Apr. 14-15, 1997, pp. 27-41, ASM International, Materials Park, Ohio, United States of America.

* cited by examiner

*Primary Examiner* — Zelalem Eshete
(74) *Attorney, Agent, or Firm* — Kelley Drye & Warren, LLP

(57) ABSTRACT

A system for actuating an engine valve is disclosed. The system may include a lost motion housing having two spaced collars surrounding a rocker shaft. The lost motion housing may include an internal hydraulic circuit connecting a hydraulic fluid supply passage with an actuator piston. The system may include a means for securing the lost motion housing in a fixed position relative to the rocker shaft.

20 Claims, 20 Drawing Sheets

INDIVIDUAL ROCKER SHAFT AND PEDESTAL MOUNTED ENGINE BRAKE

CROSS-REFERENCE TO RELATED APPLICATIONS

The present application claims the priority of provisional application Ser. No. 61/301,645 filed Feb. 5, 2010 and relates to, is a continuation in part of, and claims the priority of U.S. patent application Ser. No. 12/611,297 filed Nov. 11, 2009 entitled "Rocker Shaft Mounted Engine Brake," which is a continuation in part of, and claims the priority of U.S. patent application Ser. No. 12/076,173 filed Mar. 14, 2008 entitled "Engine Brake Having An Articulated Rocker Arm And A Rocker Shaft Mounted Housing," which relates to, and claims the priority of U.S. Provisional Patent Application Ser. No. 60/895,318 filed Mar. 16, 2007, which is entitled "Engine Brake Having an articulated Rocker Arm and a Rocker Shaft Mount Housing."

FIELD OF THE INVENTION

The present invention relates to a system and method for providing engine braking in an internal combustion engine.

BACKGROUND OF THE INVENTION

Internal combustion engines typically use either a mechanical, electrical, or hydro-mechanical valve actuation system to actuate the engine valves. These systems may include a combination of camshafts, rocker arms and push rods that are driven by the engine's crankshaft rotation. When a camshaft is used to actuate the engine valves, the timing of the valve actuation may be fixed by the size and location of the lobes on the camshaft.

For each 360 degree rotation of the camshaft, the engine completes a full cycle made up of four strokes (i.e., expansion, exhaust, intake, and compression). Both the intake and exhaust valves may be closed, and remain closed, during most of the expansion stroke wherein the piston is traveling away from the cylinder head (i.e., the volume between the cylinder head and the piston head is increasing). During positive power operation, fuel is burned during the expansion stroke and positive power is delivered by the engine. The expansion stroke ends at the bottom dead center point, at which time the piston reverses direction and the exhaust valve may be opened for a main exhaust event. A lobe on the camshaft may be synchronized to open the exhaust valve for the main exhaust event as the piston travels upward and forces combustion gases out of the cylinder. Near the end of the exhaust stroke, another lobe on the camshaft may open the intake valve for the main intake event at which time the piston travels away from the cylinder head. The intake valve closes and the intake stroke ends when the piston is near bottom dead center. Both the intake and exhaust valves are closed as the piston again travels upward for the compression stroke.

The above-referenced main intake and main exhaust valve events are required for positive power operation of an internal combustion engine. Additional auxiliary valve events, while not required, may be desirable. For example, it may be desirable to actuate the intake and/or exhaust valves during positive power or other engine operation modes for compression-release engine braking, bleeder engine braking, exhaust gas recirculation (EGR), or brake gas recirculation (BGR). FIG. 19 of co-pending application Ser. No. 11/123,063 filed May 6, 2005, which is hereby incorporated by reference, illustrates examples of a main exhaust event 600, and auxiliary valve events, such as a compression-release engine braking event 610, bleeder engine braking event 620, exhaust gas recirculation event 630, and brake gas recirculation event 640, which may be carried out by an exhaust valve using various embodiments of the present invention to actuate exhaust valves for main and auxiliary valve events.

With respect to auxiliary valve events, flow control of exhaust gas through an internal combustion engine has been used in order to provide vehicle engine braking. Generally, engine braking systems may control the flow of exhaust gas to incorporate the principles of compression-release type braking, exhaust gas recirculation, exhaust pressure regulation, full cycle bleeder and/or partial bleeder type braking.

During compression-release type engine braking, the exhaust valves may be selectively opened to convert, at least temporarily, a power producing internal combustion engine into a power absorbing air compressor. As a piston travels upward during its compression stroke, the gases that are trapped in the cylinder may be compressed. The compressed gases may oppose the upward motion of the piston. As the piston approaches the top dead center (TDC) position, at least one exhaust valve may be opened to release the compressed gases in the cylinder to the exhaust manifold, preventing the energy stored in the compressed gases from being returned to the engine on the subsequent expansion down-stroke. In doing so, the engine may develop retarding power to help slow the vehicle down. An example of a prior art compression release engine brake is provided by the disclosure of the Cummins, U.S. Pat. No. 3,220,392 (November 1965), which is hereby incorporated by reference.

During bleeder type engine braking, in addition to, and/or in place of, the main exhaust valve event, which occurs during the exhaust stroke of the piston, the exhaust valve(s) may be held slightly open during remaining three engine cycles (full-cycle bleeder brake) or during a portion of the remaining three engine cycles (partial-cycle bleeder brake). The bleeding of cylinder gases in and out of the cylinder may act to retard the engine. Usually, the initial opening of the braking valve(s) in a bleeder braking operation is in advance of the compression TDC (i.e., early valve actuation) and then lift is held constant for a period of time. As such, a bleeder type engine brake may require lower force to actuate the valve(s) due to early valve actuation, and generate less noise due to continuous bleeding instead of the rapid blow-down of a compression-release type brake.

Exhaust gas recirculation (EGR) systems may allow a portion of the exhaust gases to flow back into the engine cylinder during positive power operation. EGR may be used to reduce the amount of $NO_x$ created by the engine during positive power operations. An EGR system can also be used to control the pressure and temperature in the exhaust manifold and engine cylinder during engine braking cycles. Generally, there are two types of EGR systems, internal and external. External EGR systems recirculate exhaust gases back into the engine cylinder through an intake valve(s). Internal EGR systems recirculate exhaust gases back into the engine cylinder through an exhaust valve(s). Embodiments of the present invention primarily concern internal EGR systems.

Brake gas recirculation (BGR) systems may allow a portion of the exhaust gases to flow back into the engine cylinder during engine braking operation. Recirculation of exhaust gases back into the engine cylinder during the intake and/or early compression stroke, for example, may increase the mass of gases in the cylinder that are available for compression-release braking. As a result, BGR may increase the braking effect realized from the braking event.

SUMMARY OF THE INVENTION

Applicants have developed an innovative system for actuating an engine valve comprising: a rocker shaft having a hydraulic fluid supply passage; a lost motion housing having a collar surrounding the rocker shaft, an actuator piston bore, and an internal hydraulic circuit extending from the actuator piston bore to the hydraulic fluid supply passage; means for securing the lost motion housing in a fixed position relative to the rocker shaft; and an actuator piston slidably disposed in the actuator piston bore. In the foregoing system, the hydraulic fluid supply passage extends internally through the rocker shaft. Further, the lost motion housing may have two collars surrounding the rocker shaft. Still further, a control valve bore may be provided in the lost motion housing, wherein said control valve bore communicates with the internal hydraulic circuit and a control valve is disposed in the control valve bore. Still further, a check valve may be disposed in the control valve. Still further, the means for securing may be provided on a side of the lost motion housing which is distal from the actuator piston, on a side of the lost motion housing which is proximal to the actuator piston, or on both the side of the lost motion housing distal from the actuator piston and the side of the lost motion housing proximal to the actuator piston. Still further, the means for securing the lost motion housing may comprise a boss extending from the lost motion housing collar and a bolt extending from the boss into an engine component. Still further, the means for securing the lost motion housing may comprise a flange extending from the lost motion housing proximal to the actuator piston and a bolt extending from said flange into an engine component. Still further, the system may further comprise a solenoid valve adapted to control the supply of hydraulic fluid to said hydraulic fluid supply passage.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist the understanding of this invention, reference will now be made to the appended drawings, in which like reference characters refer to like elements. The drawings are exemplary only, and should not be construed as limiting the invention.

DETAILED DESCRIPTION OF EMBODIMENTS OF THE INVENTION

Figure 1:
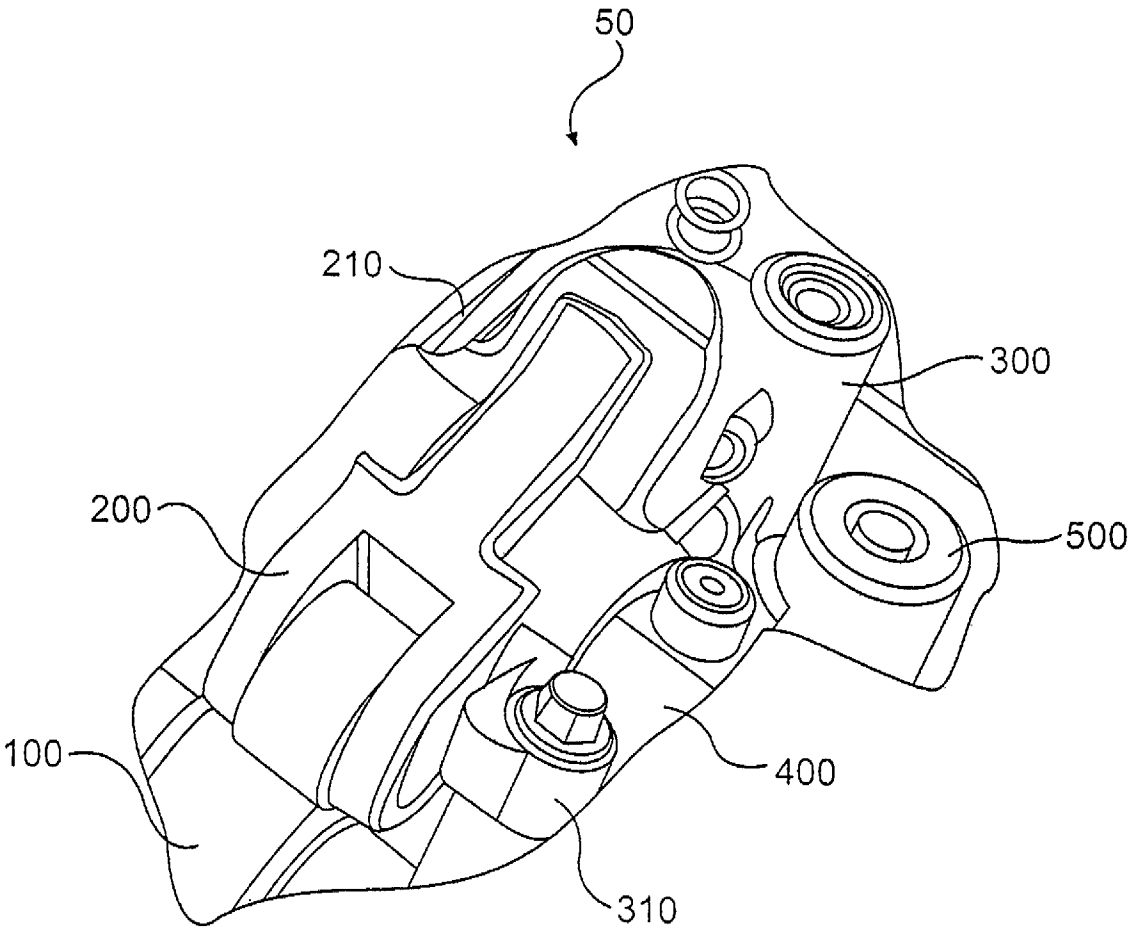
FIG. 1 is a pictorial view of an engine brake system having an articulated rocker arm and a rocker shaft mounted housing for master and slave pistons constructed in accordance with a first embodiment of the present invention and disposed in an internal combustion engine.

Reference will now be made in detail to a first embodiment of the present invention, an example of which is illustrated in the accompanying drawings. With reference to FIG. 1, a system 50 for actuating engine valves arranged in accordance with a first embodiment of the present invention is shown. FIGS. 2-9 show different views of the system shown in FIG. 1 and/or its components. The system 50 may include a cam 100, an articulated half rocker arm 200, a brake housing 300, a rocker shaft 400, and a solenoid valve 500. The rocker arm 200 may be biased away from (or alternatively towards) the cam 100 by a return spring 210 (see also FIG. 11). The brake housing may be secured in position by a anti-rotation bolt 310.

Figure 2:
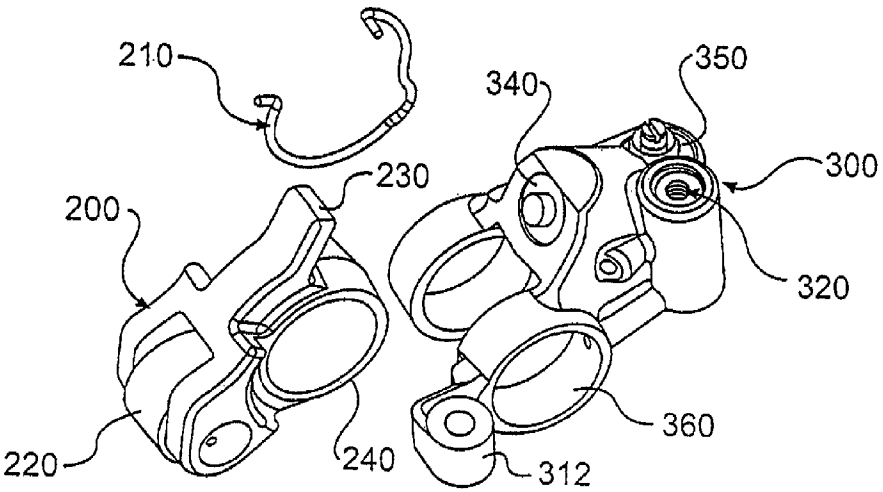
FIG. 2 is an overhead exploded pictorial view of an engine brake system having an articulated rocker arm, rocker shaft mounted housing, and a rocker arm return spring in accordance with the first embodiment of the present invention.
Figure 3:
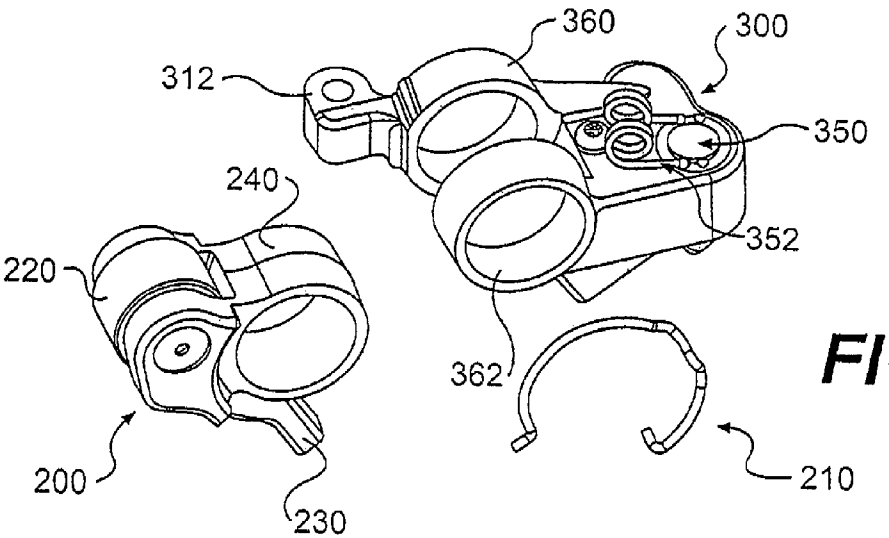
FIG. 3 is an overhead exploded pictorial view of the underside of the engine brake system shown in FIG. 2 as arranged in accordance with the first embodiment of the present invention.

With reference to FIGS. 2 and 3, the rocker arm 200 may further include a cam roller 220, a lug 230, and a central collar 240. The rocker arm return spring 210 may bias the rocker arm 200 towards the brake housing 300 such that the lug 230 contacts the master piston 340. The brake housing 300 may further include an anti-rotation bolt boss 312, a control valve 320, a master piston 340, a slave piston 350 and rocker shaft collars 360 and 362. A slave piston return spring 352 may bias the slave piston 350 up into a slave piston bore formed in the brake housing 300.

Figure 4:
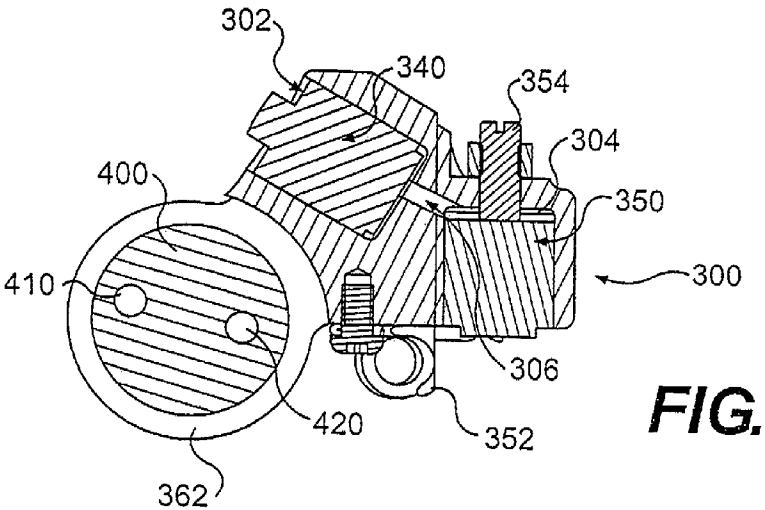
FIG. 4 is a cross-sectional side view of a rocker shaft mounted housing of FIGS. 2 and 3 which shows the master and slave pistons arranged in accordance with the first embodiment of the present invention.

With reference to FIG. 4, the rocker shaft collars 360 and 362 of the brake housing 300 may be mounted on the rocker shaft 400. The brake housing may be secured in a fixed position relative to the rocker shaft 400 by the anti-rotation bolt 310 (not shown). The brake housing 300 may include a master piston 340 slidably disposed in a master piston bore 302 and a slave piston 350 slidably disposed in a slave piston bore 304. A master-slave hydraulic fluid passage 306 may extend between the master piston bore 302 and the slave piston bore 304. The slave piston return spring 352 may bias the slave piston 350 upward and against a slave piston lash adjustment screw 354 which extends into the slave piston bore 304. The rocker shaft 400 may include a first hydraulic passage 410 adapted to provide lower pressure hydraulic fluid to the rocker arm 200 (not shown in FIG. 4) for lubrication purposes. The rocker shaft 400 may also include a second hydraulic passage 420, the purpose of which is explained in connection with FIG. 5.

Figure 5:
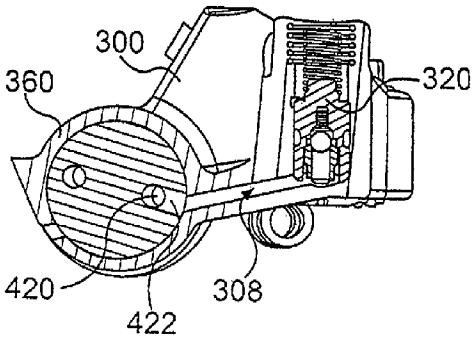
FIG. 5 is a second cross-sectional side view of the rocker shaft mounted housing of FIGS. 2 and 3 which shows the control valve in hydraulic communication with the rocker shaft and the master and slave pistons as arranged in accordance with the first embodiment of the present invention.

With reference to FIG. 5, adjacent to the slave piston 350 (shown in FIG. 4) the brake housing 300 may further include control valve 320. The control valve 320 may fill the master and slave bores with hydraulic fluid when low pressure hydraulic fluid is supplied to the lower portion of the control valve via a supply passage 308. A connection hydraulic passage 422 provided in the rocker shaft 400 may extend between the second hydraulic passage 420 and the supply passage 308 provided in the brake housing 300. As a result, hydraulic fluid may be supplied to the control valve, and the master and slave bores, by the selective supply of low pressure hydraulic fluid in the second hydraulic passage 420.

Figure 6:
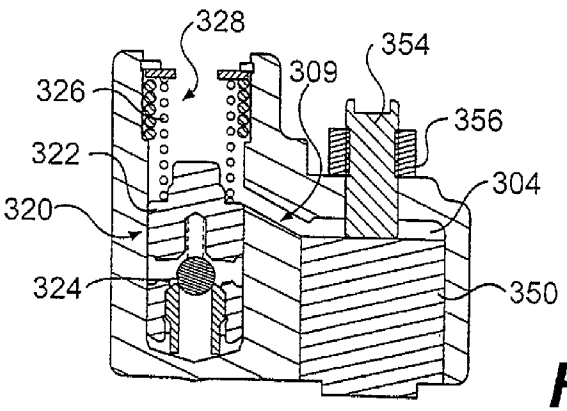
FIG. 6 is a cross-sectional front view of the rocker shaft mounted housing of FIGS. 2 and 3 showing the control valve and the slave piston as arranged in accordance with the first embodiment of the present invention.

A front cross-sectional view of the brake housing 300 is shown in FIG. 6. With reference to FIG. 6, the control valve 320 is shown in a "brake off" position during which the control valve body 322 is biased into its lower most position by the control valve spring 326. When the brake is turned on, hydraulic fluid from the second hydraulic passage 420 in the rocker shaft 400 (shown in FIG. 5) may be supplied to the lower portion of the control valve body 322. The supply of hydraulic fluid may cause the control valve body 322 to move upward until the annular opening provided in the mid-portion of the control valve body registers with the slave bore supply passage 309. The hydraulic fluid pressure applied to the lower portion of the control valve 320 may be sufficient to push the check valve 324 open so that hydraulic fluid flows into the slave piston bore 304 via the slave bore supply passage 309. With renewed reference to FIG. 4, the hydraulic fluid may further flow from the slave piston bore 304 through the master-slave hydraulic fluid passage 306 into the master piston bore 302. While the brake is in a "brake on" position, hydraulic fluid may be supplied freely to the master-slave piston circuit by the control valve 320, while the check valve 324 within the control valve prevents the reverse flow of fluid. As a result, the master-slave hydraulic circuit in the brake housing 300 may experience high hydraulic fluid pressures without substantial back flow of hydraulic fluid.

The brake may be returned to the "brake off" position shown in FIG. 6 by reducing the hydraulic fluid pressure, preferably by evacuating the hydraulic fluid, applied to the lower portion of the control valve 320. When this happens, the control valve body 322 may slide downward until the slave bore supply passage 309 is exposed to the control valve bore 328, thereby allowing the hydraulic fluid in the master-slave hydraulic circuit to escape. The selective supply of hydraulic fluid to the control valve 320 may be controlled by the solenoid 500 shown in FIG. 1. Alternative placements of the solenoid 500 are considered within the scope of the present invention.

Figure 7:
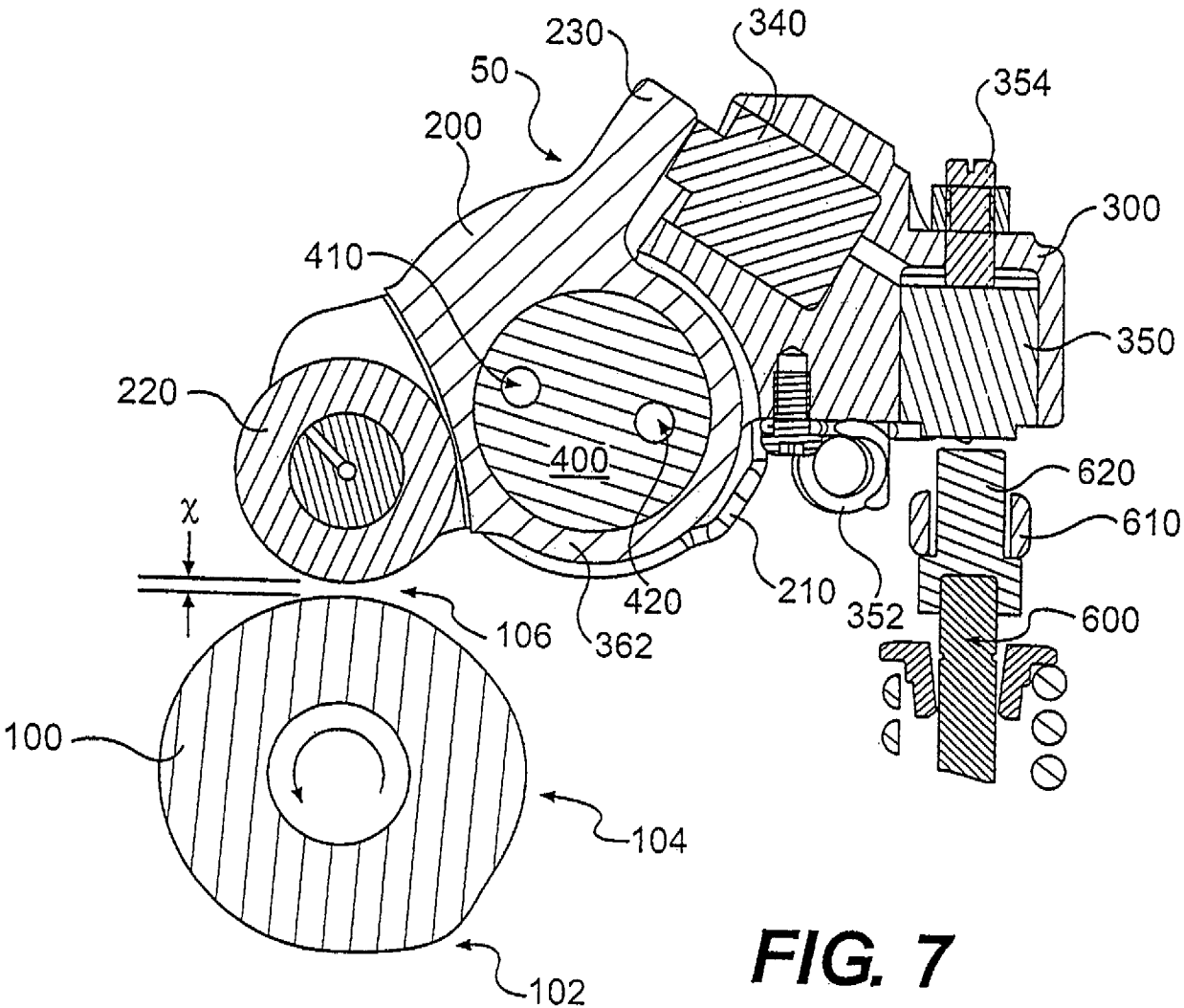
FIG. 7 is a cross-sectional side view of the engine brake system of FIGS. 2 and 3 showing the articulated rocker arm, rocker shaft mounted housing, and cam lobe as arranged in accordance with the first embodiment of the present invention when the engine brake system is turned off.

The arrangement of the various elements of the system 50 when the engine brake is in a "brake off" position is shown in FIG. 7. With reference to FIG. 7, the cam lobe 100 is illustrated as having two valve actuation bumps. A first cam bump 102 may provide a compression-release valve actuation event and a second cam bump 104 may provide a brake gas recirculation (BGR) valve actuation event. Alternative cam lobes with more, less, or different cam bumps are contemplated as being within the scope of the present invention.

The system 50 is positioned adjacent to an engine valve, such as an exhaust valve 600. The system 50 may actuate the exhaust valve 600 through a sliding pin 620 that extends through a valve bridge 610. Use of such a sliding pin and valve bridge arrangement may permit a separate valve actuation system to actuate multiple engine valves for positive power operation and a single engine valve 600 for non-positive power operation, such as engine braking.

With continued reference to FIG. 7, when the brake is in a "brake off" position, hydraulic fluid pressure in the second hydraulic passage 420 is reduced or eliminated. As a result, there is no hydraulic fluid pressure maintained in the master-slave hydraulic fluid circuit connecting the master piston 340 and the slave piston 350. Accordingly, the bias of the slave piston return spring 352 may be sufficient to push the slave piston 350 all the way into the slave piston bore against the lash adjustment screw 354. Furthermore, the bias of the rocker arm return spring 210 may be sufficient to rotate the rocker arm 200 such that the rocker arm lug 230 pushes the master piston 340 all the way into the master piston bore. The rotation of the rocker arm 200 in this manner may create a lash space 106 between the cam roller 220 and the cam lobe 100. The lash space 106 may be designed to have a magnitude x that is as great or greater than the height of the cam bumps 102 and 104. Thus, when the system 50 is in a "brake off" position, the cam bumps 102 and 104 may not have any effect on the rocker arm 200 or the master and slave pistons 340 and 350.

Figure 8:
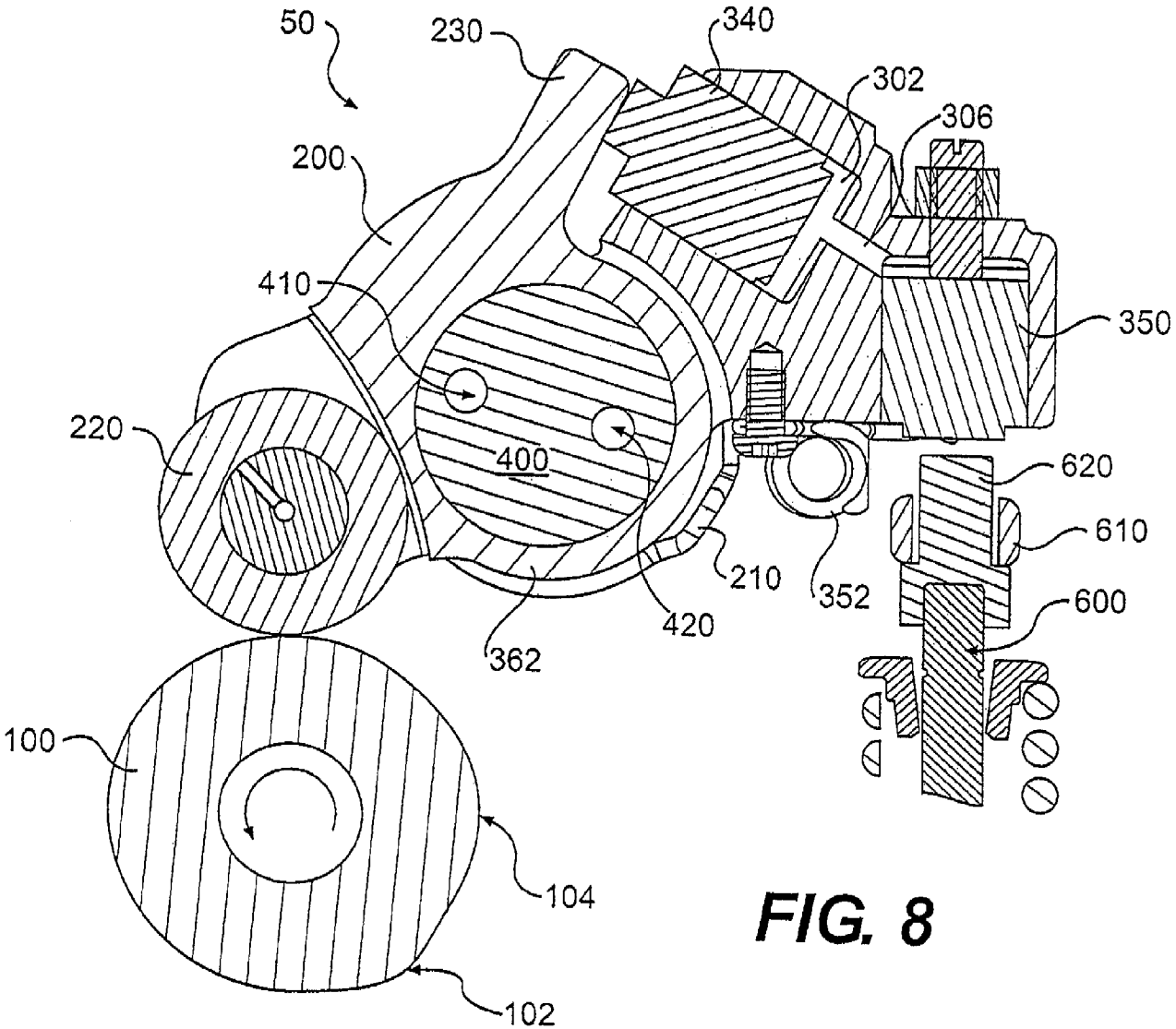
FIG. 8 is a cross-sectional side view of the engine brake system of FIGS. 2 and 3 showing the articulated rocker arm, rocker shaft mounted housing, and cam lobe as arranged in accordance with the first embodiment of the present invention when the engine brake system is turned on and rocker arm is contacting the cam base circle.

The arrangement of the various elements of the system 50 when the engine brake is in a "brake on" position is shown in FIG. 8. With reference to FIG. 8, when the brake is turned "on," hydraulic fluid is supplied through the second hydraulic passage 420 to the control valve 320 (not shown) and the master-piston hydraulic circuit in the brake housing. When the cam lobe 100 is at base circle, as shown in FIG. 8, the hydraulic fluid pressure in the master-slave hydraulic fluid circuit connecting the master piston 340 and the slave piston 350 may push the master piston 340 out of its bore, overcoming the bias of the rocker arm return spring 210 and rotating the rocker arm 200 backwards until the cam roller 220 contacts the cam lobe 100. As a result, the lash space 106 may be eliminated. At this time (cam lobe at base circle), the hydraulic pressure in the master-slave hydraulic circuit is not sufficient, however, overcome the bias of the slave piston return spring 352 and push the slave piston 350 out of the slave piston bore.

Figure 9:
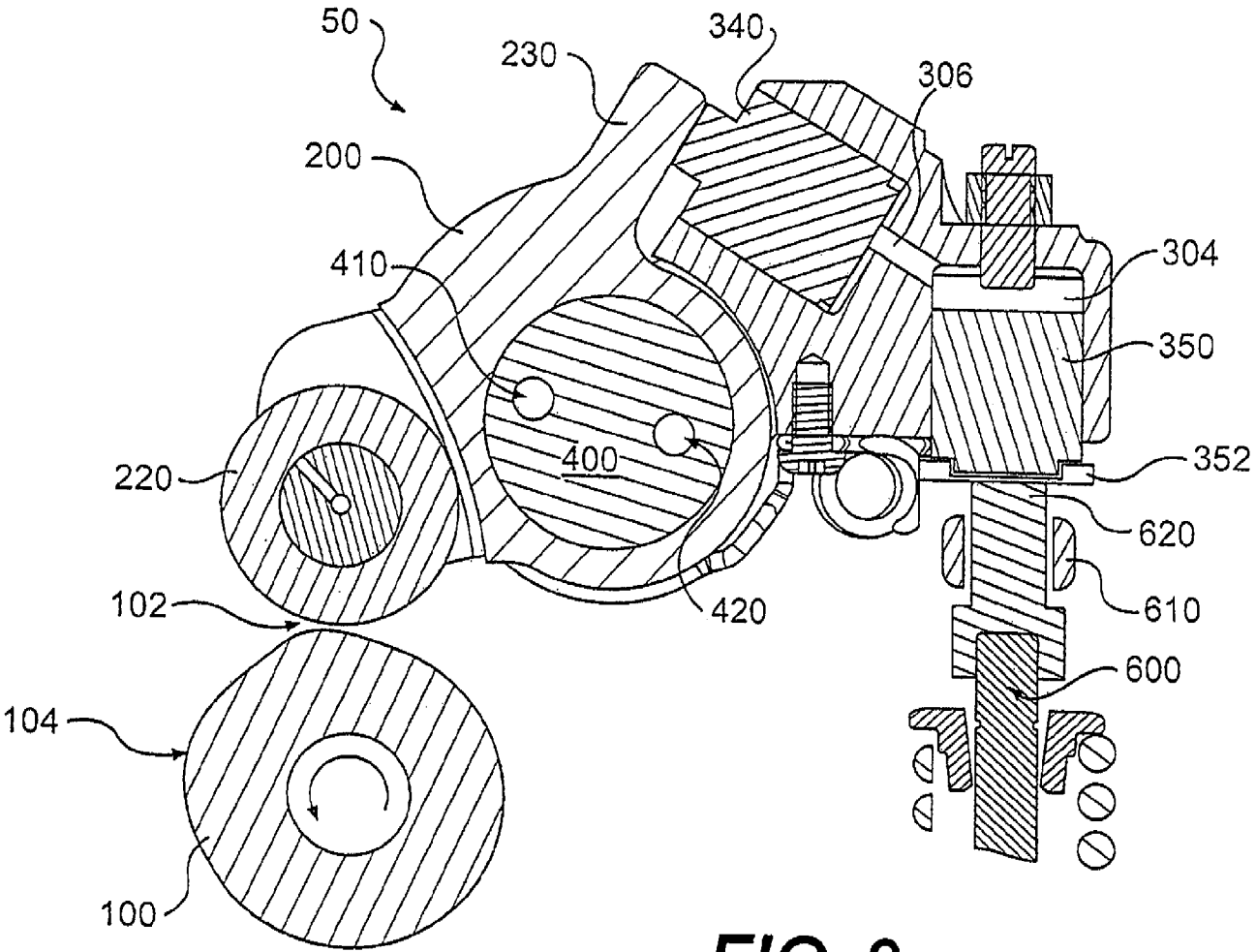
FIG. 9 is a cross-sectional side view of the engine brake system of FIGS. 2 and 3 showing the articulated rocker arm, rocker shaft mounted housing, and cam lobe as arranged in accordance with the first embodiment of the present invention when the engine brake system is turned on and the rocker arm is contacting the cam compression-release bump.

With reference to FIG. 9, when the cam roller 220 encounters the cam bump 102 (and 104), the rocker arm 200 is rotated slightly clockwise. Rotation of the rocker arm 200 may push the master piston 340 into the master piston bore thereby displacing hydraulic fluid through the master-slave hydraulic fluid passage 306 and into the slave piston bore. As a result, the bias of the slave piston return spring 352 is overcome and the slave piston 350 may be displaced downward against the sliding pin 620, which in turn, may actuate the exhaust valve 600 for a compression-release event or some alternative valve actuation event.

Figure 10:
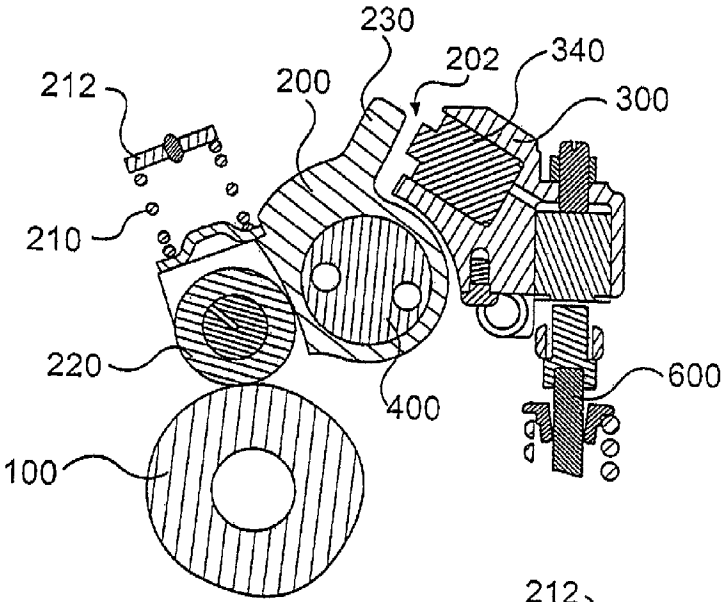
FIG. 10 is a cross-sectional side view of an engine brake system showing the articulated rocker arm, rocker shaft mounted housing, and cam lobe as arranged in accordance with a second embodiment of the present invention when the engine brake system is turned off.
Figure 11:
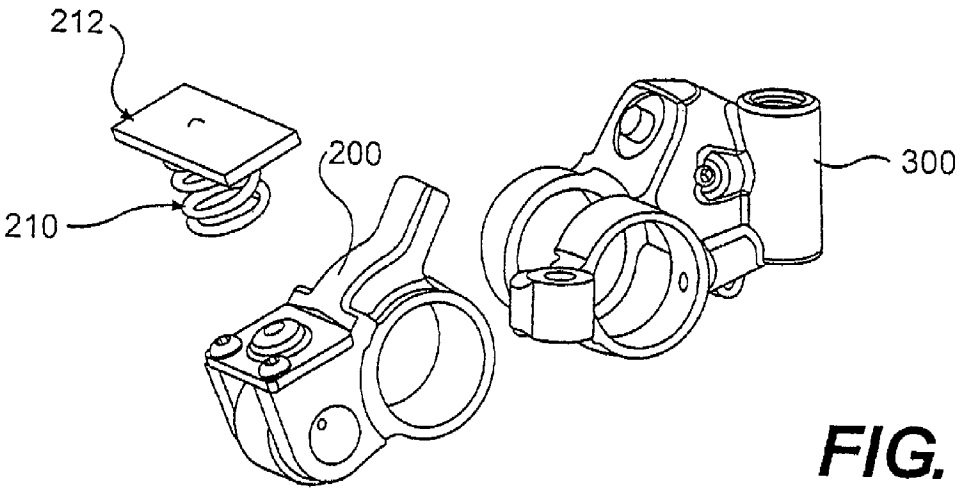
FIG. 11 is an exploded pictorial view of an engine brake system having an articulated rocker arm, rocker shaft mounted housing, and a rocker arm return spring in accordance with the second embodiment of the present invention.

An alternative embodiment of the present invention is shown in FIGS. 10 and 11. With reference to FIGS. 10 and 11, the rocker arm return spring 210 may be provided in the form of a coil spring as opposed to a mouse-trap type spring. Furthermore, the return spring 210 may extend between an overhead element 212 and a rear portion of the rocker arm 200 such that the rocker arm is biased into continual contact with the cam lobe 100 when the system is in a "brake off" position, as shown in FIG. 10. As a result, instead of creating a lash space between the cam lobe 100 and the cam roller 220 when the brake is off, a lash space 202 may be created between the rocker arm lug 230 and the master piston 340.

Figure 12:
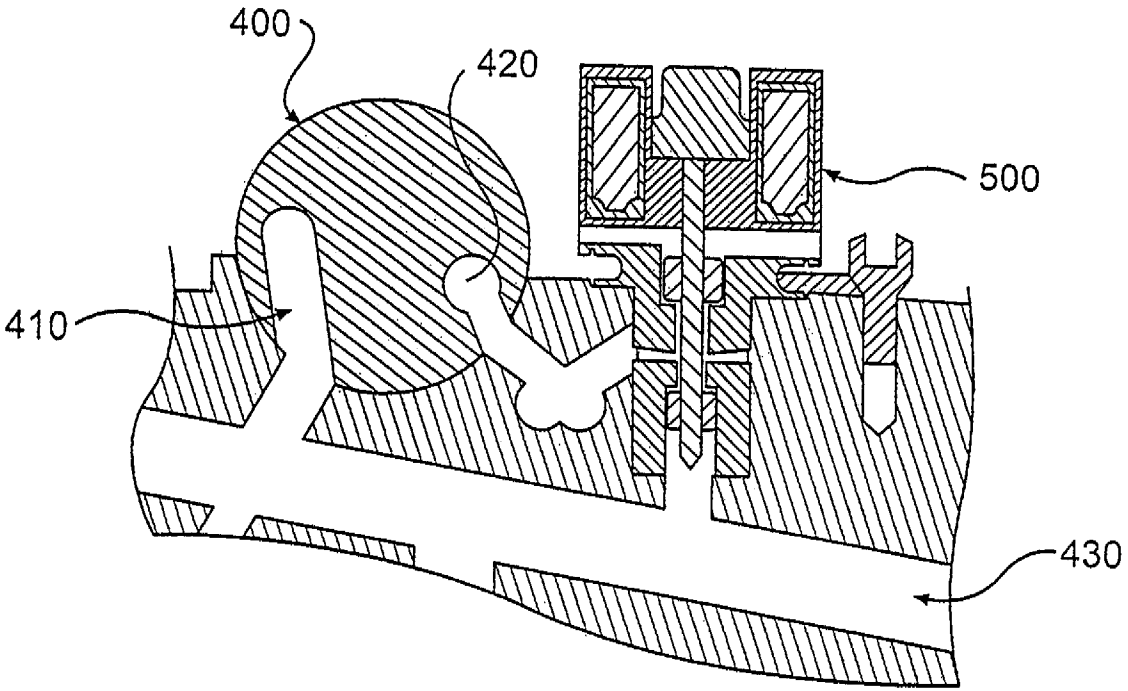
FIG. 12 is a cross-sectional side view of the engine brake system of FIGS. 2 and 3 showing the oil passage schematic between the engine oil supply passage, solenoid valve and rocker shaft.

With reference to FIG. 12, the communication between an engine oil supply passage 430 and the first and second hydraulic passages 410 and 420 are shown. The solenoid 500 may be disposed between the engine oil supply passage 430 and the rocker shaft 400.

Figure 13:
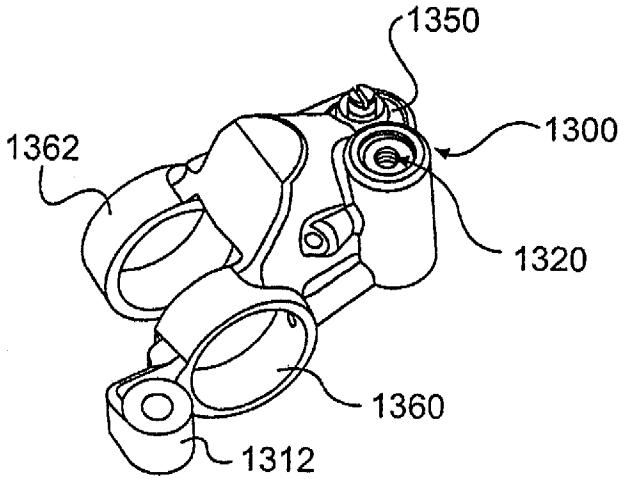
FIG. 13 is an overhead pictorial view of a valve actuation system that may be used for bleeder braking in particular, having a rocker shaft mounted housing in accordance with a second embodiment of the present invention.
Figure 14:
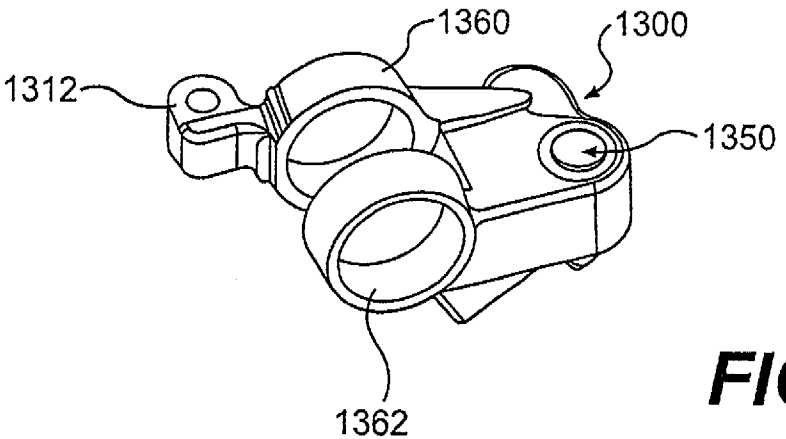
FIG. 14 is a pictorial view of the underside of the valve actuation system shown in FIG. 13 as arranged in accordance with the second embodiment of the present invention.

With reference to FIGS. 13 and 14, in a second embodiment of the present invention, the rocker arm and master piston may be eliminated. The valve actuation system housing 1300 may include an anti-rotation bolt boss 1312, a control valve 1320, an actuator piston 1350 and rocker shaft collars 1360 and 1362. The rocker shaft collars may surround the rocker shaft providing a means for securely fixing the housing 1300 in a fixed and compact position relative to the engine valves to be actuated.

Figure 15:
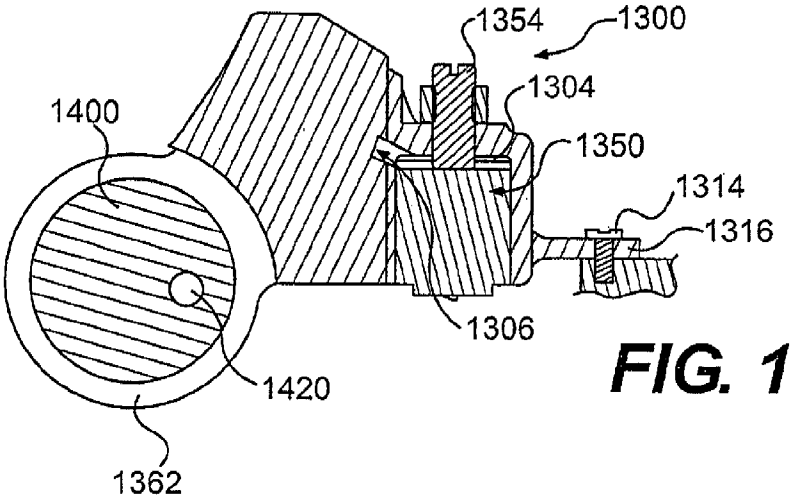
FIG. 15 is a cross-sectional side view of a rocker shaft mounted housing of FIGS. 13 and 14 which shows an alternative or additional flange for securing the rocker shaft mounted housing in a fixed position in accordance with an alternative embodiment of the present invention.

With reference to FIG. 15, the rocker shaft collars 1360 and 1362 of the housing 1300 may be mounted on the rocker shaft 1400. The housing may be secured in a fixed position relative to the rocker shaft 1400 by a first anti-rotation bolt 1310 (not shown) that extends through the anti-rotation bolt boss 1312 and/or by a second anti-rotation bolt 1314 that extends through an anti-rotation flange 1316. The anti-rotation boss 1312 may be provided distal from the actuator piston 1350 and the anti-rotation flange 1316 may be provided proximal to the actuator piston. The housing 1300 may include an actuator piston 1350 slidably disposed in an actuator piston bore 1304. An internal hydraulic circuit may include passage 1306 and passage 1308 (shown in FIG. 16). An actuator piston lash adjustment screw 1354 may extend into the actuator piston bore 1304 and provide an upper stop against which the actuator piston 1350 may seat. The rocker shaft 1400 may include a hydraulic fluid supply passage 1420, the purpose of which is explained in connection with FIG. 16.

Figure 16:
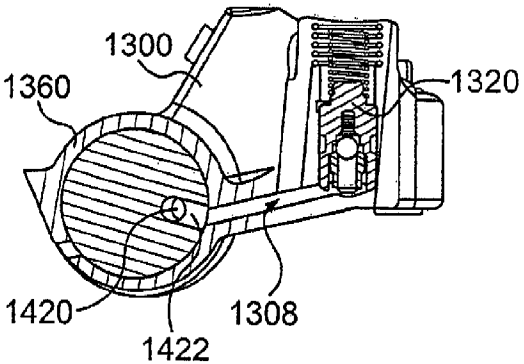
FIG. 16 is a second cross-sectional side view of the rocker shaft mounted housing of FIGS. 13 and 14 which shows the control valve in hydraulic communication with the rocker shaft and the actuator piston as arranged in accordance with the second embodiment of the present invention.

With reference to FIG. 16, adjacent to the actuator piston 1350 (shown in FIG. 15) the housing 1300 may further include a control valve 1320. The control valve 1320 may fill the passage 1306 of the internal hydraulic circuit with hydraulic fluid when low pressure hydraulic fluid is supplied to the lower portion of the control valve via a passage 1308 of the internal hydraulic circuit. A connection hydraulic passage 1422 provided in the rocker shaft 1400 may extend between the hydraulic fluid supply passage 1420 and the passage 1308 provided in the housing 1300. As a result, hydraulic fluid may be supplied to the control valve and the actuator piston bores by the selective supply of low pressure hydraulic fluid in the hydraulic fluid supply passage 1420.

Figure 17:
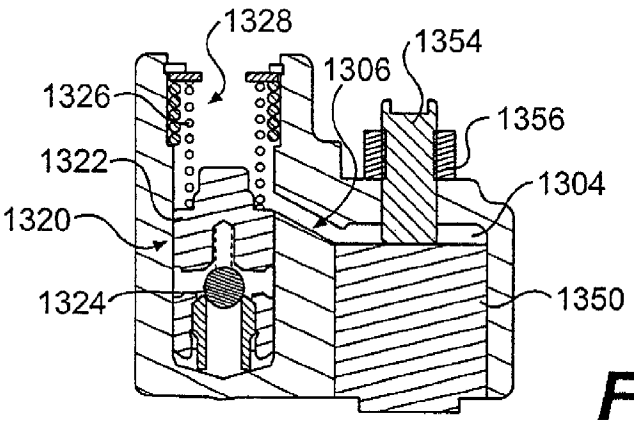
FIG. 17 is a cross-sectional front view of the rocker shaft mounted housing of FIGS. 13 and 14 showing the control valve and the actuator piston as arranged in accordance with the second embodiment of the present invention.

A front cross-sectional view of the system is shown in FIG. 17. With reference to FIG. 17, the control valve 1320 is shown in a "actuator off" position during which the control valve body 1322 is biased into its lower most position by the control valve spring 1326. When the system is turned on, hydraulic fluid from the hydraulic fluid supply passage 1420 in the rocker shaft 1400 (shown in FIG. 16) may be supplied to the lower portion of the control valve body 1322. The supply of hydraulic fluid may cause the control valve body 1322 to move upward until the annular opening provided in the mid-portion of the control valve body registers with the passage 1306. The hydraulic fluid pressure applied to the lower portion of the control valve 1320 may be sufficient to push the check valve 1324 open so that hydraulic fluid flows into the actuator piston bore 1304 via the passage 1306. While the system is in an "actuator on" position, hydraulic fluid may be supplied freely to the internal hydraulic circuit by the control valve 1320, while the check valve 1324 within the control valve prevents the reverse flow of fluid. As a result, the internal hydraulic circuit in the housing 1300 may experience high hydraulic fluid pressures without substantial back flow of hydraulic fluid.

The system may be returned to the "actuator off" position shown in FIG. 17 by reducing the hydraulic fluid pressure in the hydraulic fluid supply passage 1420, and preferably by evacuating the hydraulic fluid applied to the lower portion of the control valve 1320. When this happens, the control valve body 1322 may slide downward until the passage 1306 is exposed to the control valve bore 1328, thereby allowing the hydraulic fluid in the internal hydraulic circuit to escape. The selective supply of hydraulic fluid to the control valve 1320 may be controlled by the solenoid 1500 shown in FIG. 20. Alternative placements of the solenoid 1500 are considered within the scope of the present invention.

Figure 18:
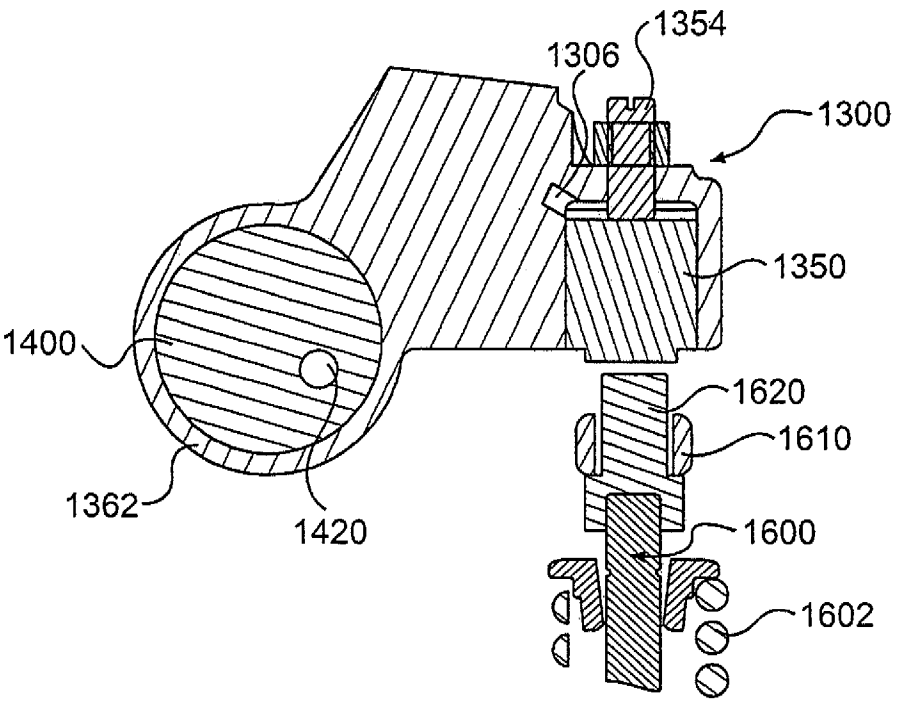
FIG. 18 is a cross-sectional side view of the valve actuation system of FIGS. 13 and 14 showing the rocker shaft mounted housing and actuator piston as arranged in accordance with the second embodiment of the present invention when the actuator piston is separated by a lash space from the sliding pin/engine valve.

The arrangement of the various elements of the system when the engine valve actuator is in an "actuator off" position is shown in FIG. 18. With reference to FIG. 18, the system is positioned adjacent to an engine valve, such as an exhaust valve 1600. The system may actuate the exhaust valve 1600 through a sliding pin 1620 that extends through a valve bridge 1610. Use of such a sliding pin and valve bridge arrangement may permit a separate valve actuation system to actuate multiple engine valves for positive power operation and a single engine valve 1600 for non-positive power operation, such as engine braking. With continued reference to FIG. 18, when the system is in an "actuator off" position, hydraulic fluid pressure in the hydraulic fluid supply passage 1420 is reduced or eliminated. As a result, there is no hydraulic fluid pressure maintained in the internal hydraulic fluid circuit connected to the actuator piston 1350. As a result, the actuator piston 1350 may rest against but not actuate the sliding pin 1620. Thus, when the system is in an "actuator off" position, the actuator piston may not provide any valve actuation motion to the engine valve.

Figure 19:
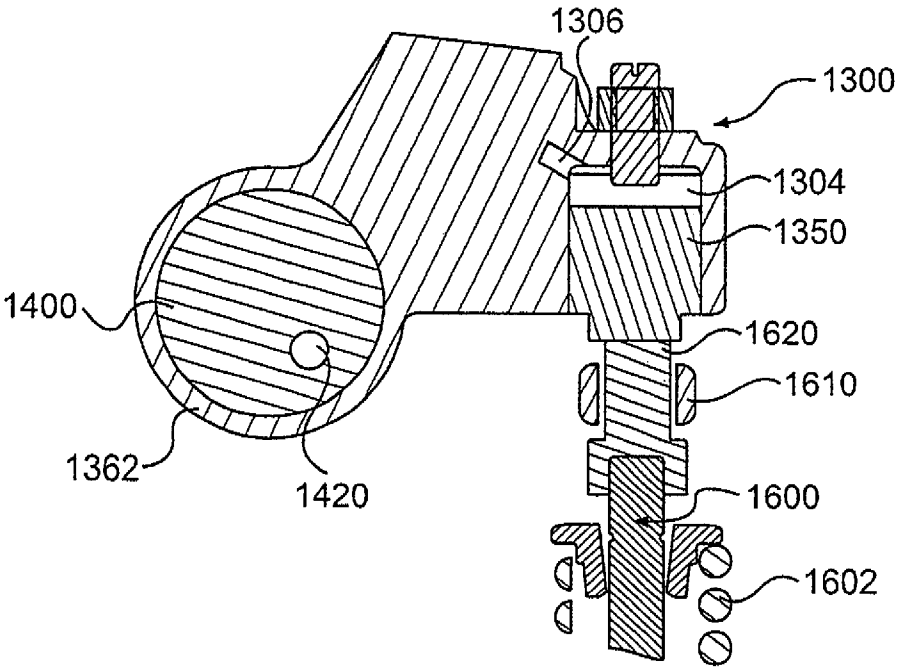
FIG. 19 is a cross-sectional side view of the valve actuation system of FIGS. 13 and 14 showing the rocker shaft mounted housing and actuator piston as arranged in accordance with the second embodiment of the present invention when the system is turned on and the actuator piston has actuated the engine valve.

The arrangement of the various elements of the system when it is in an "actuator on" position is shown in FIG. 19. With reference to FIG. 19, when the system is turned "on," hydraulic fluid is supplied through the hydraulic passage 1420 to the control valve 1320 (not shown). Hydraulic fluid pressure in the passage 1306 may push the actuator piston 1350 out of its bore so that if it is not already, it does contact the sliding pin 1620. At this time the hydraulic pressure in the internal hydraulic circuit may not be sufficient, however, to overcome the bias of the engine valve 1600 spring 1602. When the valve bridge 1610 is moved downward for main exhaust valve actuation event, for example, the low pressure hydraulic fluid in the actuator piston bore 1304 may push the actuator piston 1350 and the sliding pin 1620 downward so that they follow the valve bridge until the actuator piston reaches its maximum downward displacement. As the valve bridge 1610 returns upward at the conclusion of the main exhaust event, the hydraulic fluid in the passage 1306 may become highly pressurized so that the actuator piston 1350 holds the exhaust valve 1600 open for an engine valve event, such as a bleeder braking event. The actuator piston 1350 may continue to hold the exhaust valve 1600 open until the control valve 1320 releases the hydraulic fluid pressure in the passage 1306. It is appreciated that the valve actuation system may be used for intake and auxiliary engine valve actuation in addition to exhaust valve actuation.

Figure 20:
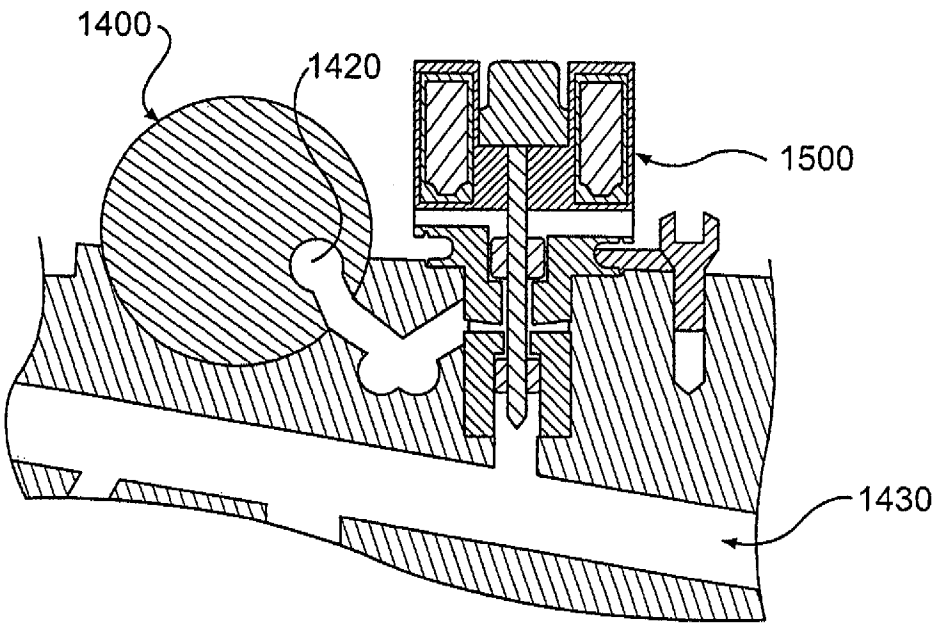
FIG. 20 is a cross-sectional side view of the valve actuation system of FIGS. 13 and 14 illustrating control of hydraulic fluid supply by a solenoid valve.

With reference to FIG. 20, the communication between an engine hydraulic fluid supply passage 1430 and the hydraulic fluid supply passage 1420 is shown. The solenoid valve 1500 may be disposed between the engine hydraulic fluid supply passage 1430 and the hydraulic fluid supply passage 1420 in the rocker shaft 1400. The solenoid valve 1500 may be provided adjacent to the rocker shaft mounted engine brake system on, for example, a rocker shaft pedestal.

Figure 21:
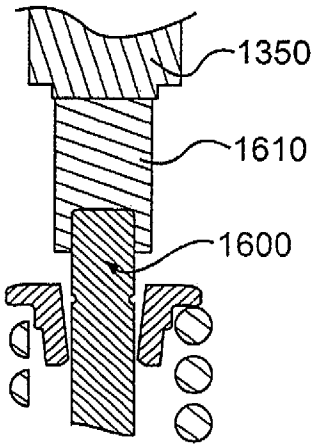
FIG. 21 is a cross-sectional side view of a valve bridge disposed between an actuator piston and an engine valve in accordance with an alternative embodiment of the present invention.

With reference to FIG. 21, in an alternative embodiment of the system shown in FIGS. 13-20, the actuator piston 1350 may act directly on an engine valve 1600 or on an engine valve bridge 1610 instead of acting on a sliding pin.

Figure 22:
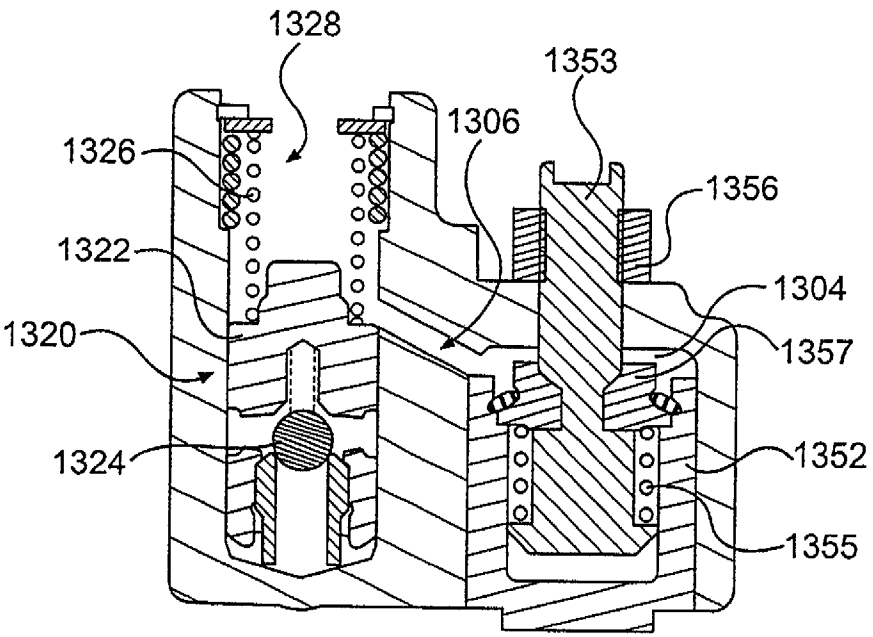
FIG. 22 is a cross-sectional view of an alternative actuator piston in accordance with an alternative embodiment of the present invention.

With reference to FIG. 22, in another alternative embodiment of the system shown in FIGS. 13-21, the solid actuator piston 1350 may be replaced with an auto-lashing actuator piston 1352. The auto-lashing piston 1352 may include an actuator piston with a hollow interior which receives an adjustable depth lash adjustment screw-plunger 1353, spring 1355, and retaining collar 1357. The adjustable depth lash adjustment screw-plunger may be partially disposed in the hollow interior of the actuator piston 1352 and extend out of the top of the actuator piston bore 1304. The adjustable depth lash adjustment screw-plunger 1353 may have a lower plunger end and the retaining collar 1357 may be disposed in the hollow interior of the actuator piston 1352 above the lower plunger end. The spring 1355 may be disposed between the retaining collar 1357 and the lower plunger end. The auto-lashing actuator piston 1352 may be maintained out of contact with sliding pin 1620 (as shown in FIG. 18) when the system is in an "actuator off" position.

With reference to FIGS. 23-28, in another alternative embodiment of the system, the brake housing 2300 may be mounted on individual rocker shaft 2200 and rocker shaft pedestal 2100 (not shown) assemblies. In this embodiment, the brake housing 2300 may be like the brake housing 300 and 1300 described in the preceding paragraph and the drawings.

Figure 23:
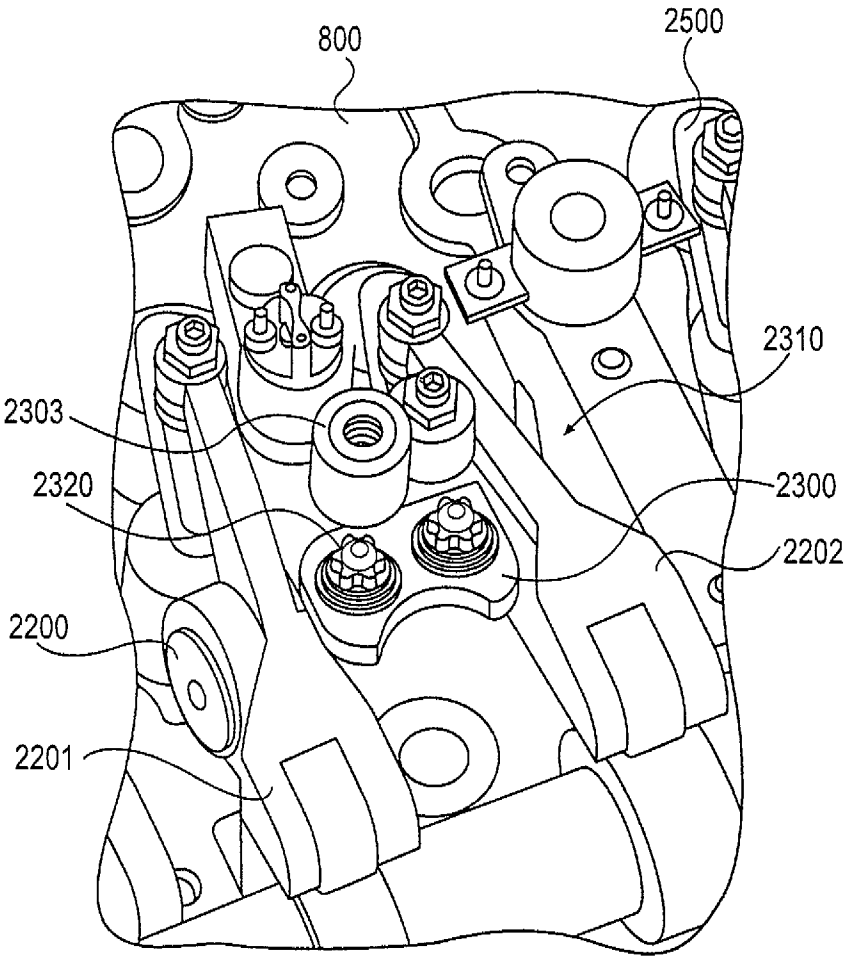
FIG. 23 is a pictorial view of an engine brake system having an individual rocker shaft and rocker shaft pedestal assembly, two articulated rocker arms (an exhaust rocker arms and an intake rocker arms), rocker arm shaft mounted brake housing, and a solenoid valve mounted in the solenoid valve bore in accordance with an embodiment of the present invention and disposed in an internal combustion engine.
Figure 24:
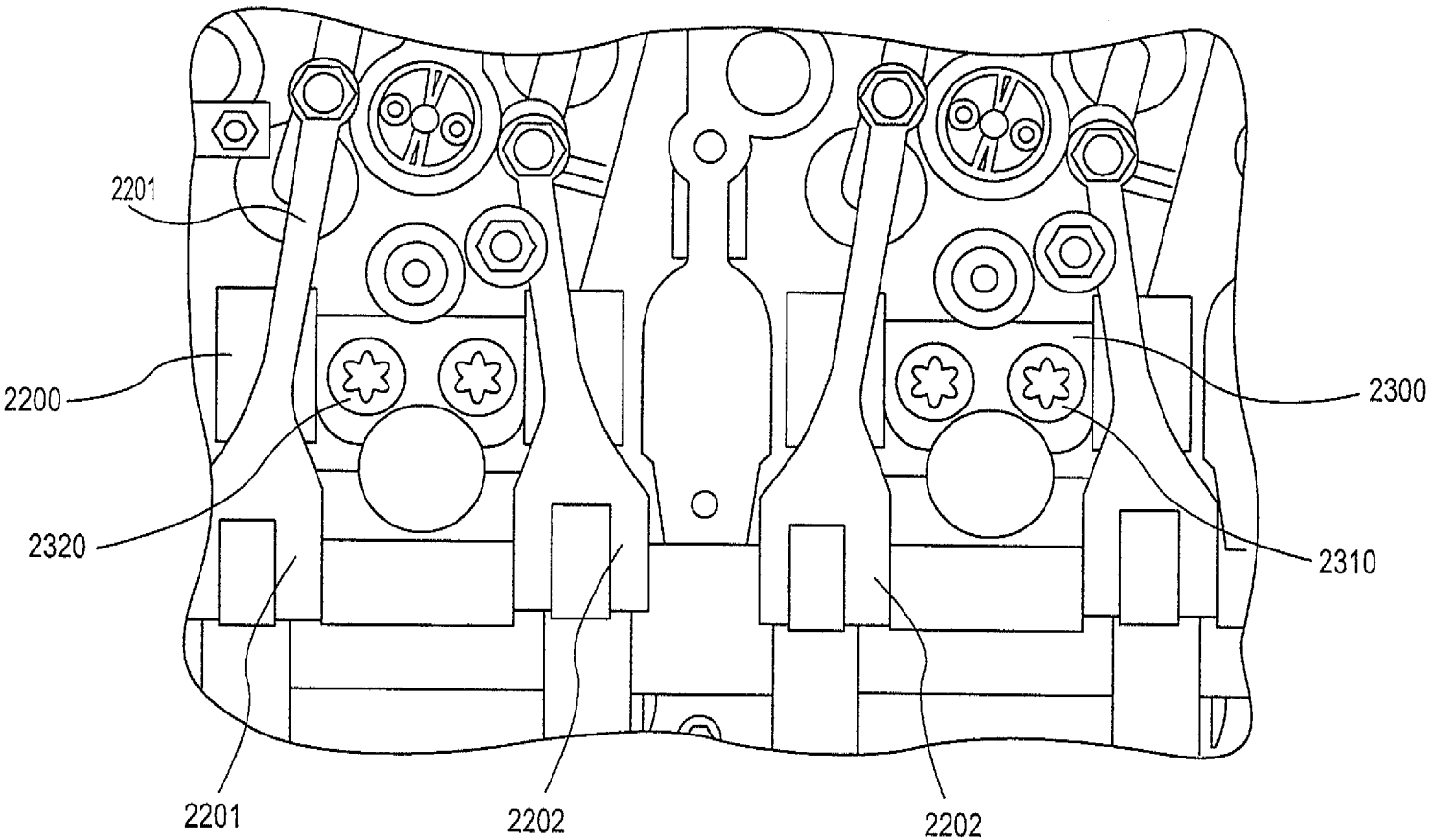
FIG. 24 is a pictorial view of an engine brake system having two individual rocker shaft and rocker shaft pedestal assemblies, four articulated rocker arms (two exhaust rocker arms and two intake rocker arms), and rocker arm shaft mounted brake housing in accordance with an embodiment of the present invention and disposed in an internal combustion engine.

With reference to FIGS. 23 and 24, each engine valve may have one individual rocker shaft 2200 and rocker shaft pedestal 2100 (not shown) assembly. Two rocker arms, an intake rocker arm 2201 and an exhaust rocker arm 2202, may be mounted on each rocker shaft 2200. The brake housing 2300 may be secured in a fixed position relative to the rocker shaft 2200 by a first bolt 2310 that extends through the rocker shaft pedestal 2100 (not shown) and/or by a second bolt 2320 that also extends through the rocker shaft pedestal 2100 (not shown). The first bolt 2310 and/or the second bolt 2320 may extend through the rocker shaft pedestal 2100 (not shown) and into the cylinder head 800. Alternatively, the brake housing 2300 may be secured in a fixed position relative to the rocker shaft 2200 by three bolts that extend through the rocker shaft pedestal 2100 (not shown) and/or into the cylinder head 800.

Figure 26:
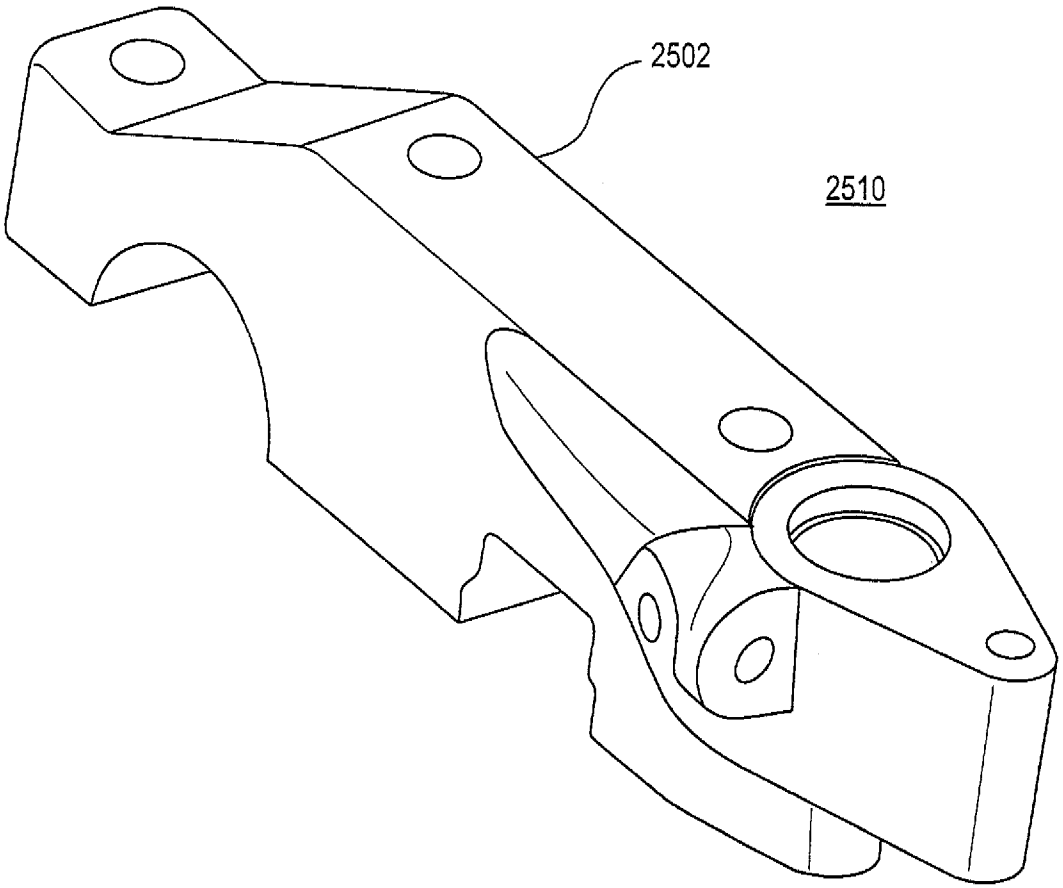
FIG. 26 is an overhead pictorial view of a cam cap showing a solenoid valve bore for receiving a solenoid valve in accordance with an embodiment of the present invention.
Figure 27:
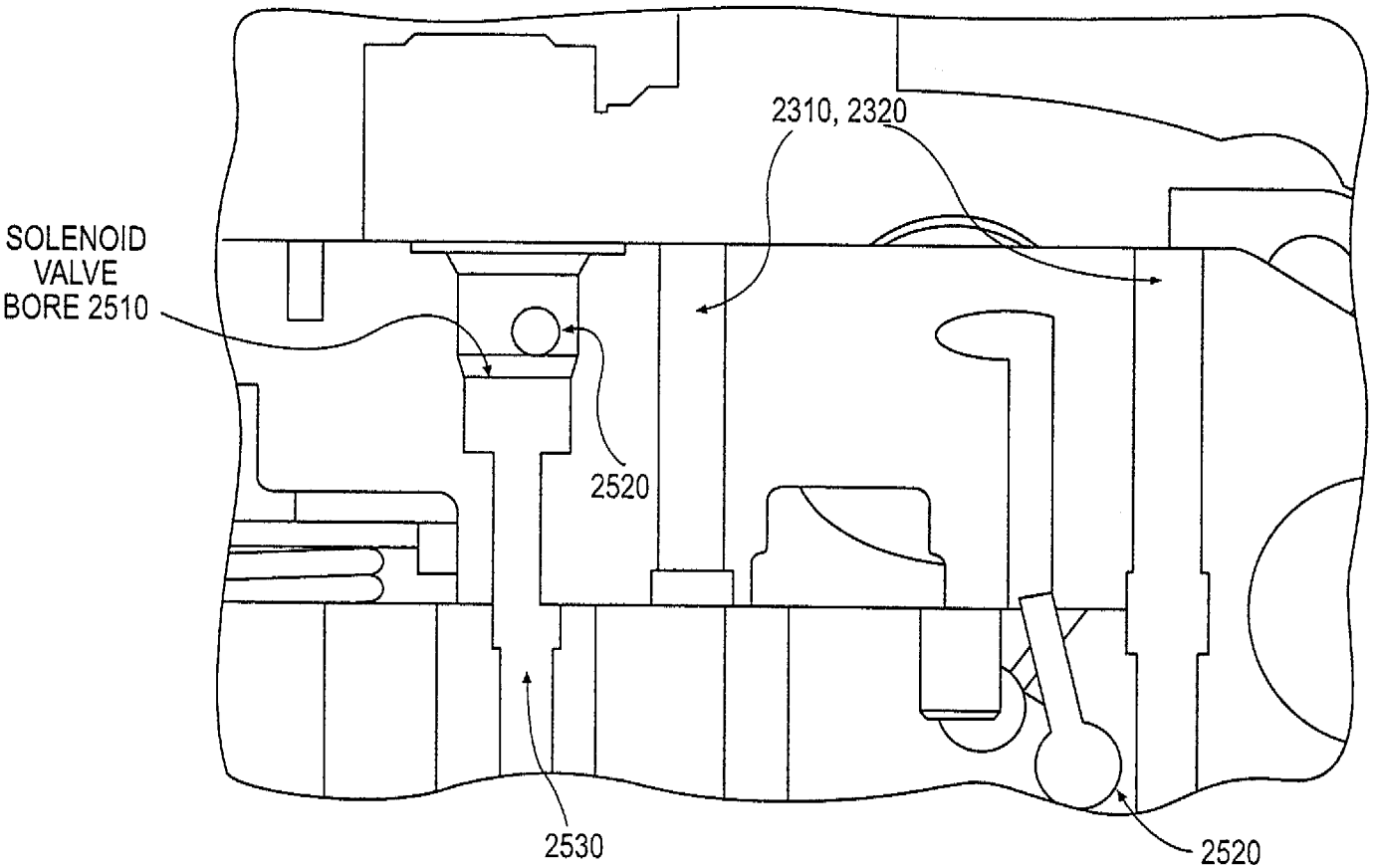
FIG. 27 is a pictorial cross-sectional view of the rocker shaft mounted brake housing and the solenoid valve mounted in the solenoid valve bore of FIG. 23 showing the engine oil supply passage to the solenoid valve and the brake actuation oil passage to each rocker shaft and rocker shaft pedestal assembly in accordance to an embodiment of the present invention.

With reference to FIGS. 23, 24, and 27, the communication between an engine oil supply passage 2530 and a brake actuation oil passage 2520 is shown. A solenoid valve 2500 may be mounted in the solenoid valve bore 2510, as shown in FIGS. 23 and 26. The solenoid valve 2500 may be provided adjacent to the rocker shaft mounted engine brake system on, for example, a cam cap 2502 or the rocker shaft pedestal 2100 (not shown). The solenoid valve may be connected to the engine oil supply passage 2530 and may selective supply hydraulic oil to a brake actuation oil passage 2520. The brake actuation oil passage 2520 may be incorporated in the cylinder head 800.

Figure 25:
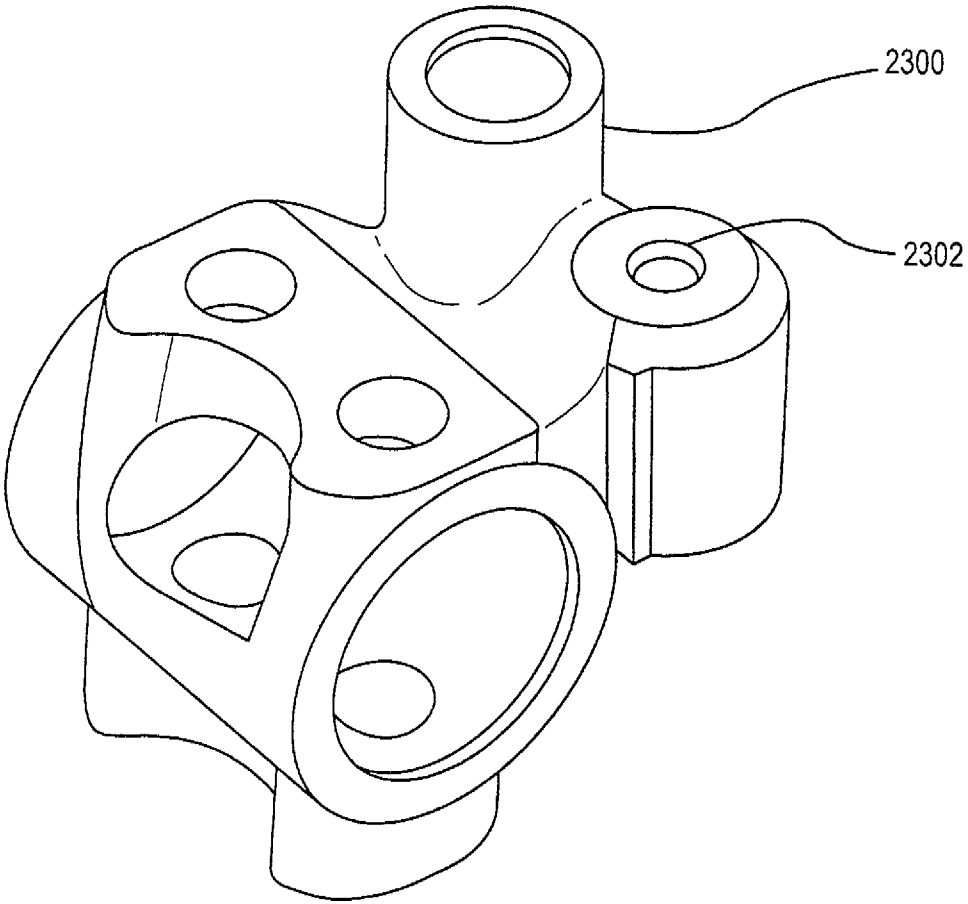
FIG. 25 is an overhead pictorial view of an engine brake system having a rocker shaft mounted brake housing in accordance with an embodiment of the present invention.
Figure 28:
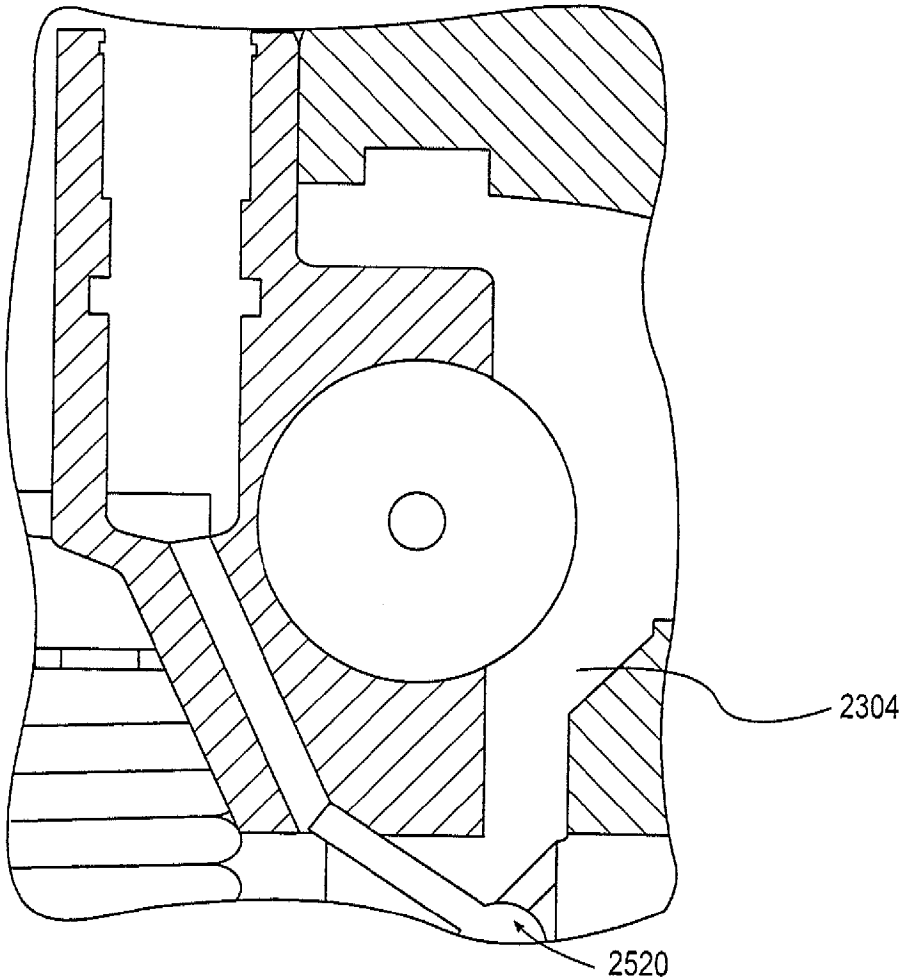
FIG. 28 is a pictorial cross-sectional view of the rocker shaft mounted brake housing of FIGS. 23, 24, and 25 that shows the brake actuation oil passage to each rocker shaft and pedestal assembly and the actuator oil supply passages contained in the rocker shaft mounted brake housing in accordance to an embodiment of the present invention.

With reference to FIGS. 25 and 28, the brake housing 2300 may include actuator piston 2301 slidably disposed in an actuator piston bore 2302 and a control valve 2303. The brake housing 2300 may also contain actuator oil supply passages 2304 that may selective supply low pressure hydraulic fluid to the actuator piston bore 2302 and the control valve 2303. The actuator oil supply passages 2304 for each brake housing 2300 may be connected to the brake actuation oil passage 2520. As a result, hydraulic fluid may be supplied to the control valve 2303 and the actuator piston bore 2302 by the selective supply of low pressure hydraulic fluid in the brake actuation oil passage 2520.

Alternatively, an external physical hydraulic passage, such as, tubes with "banjo" fittings or individual "jumper" tubes between rocker shaft pedestals 2100 (not shown) may be incorporated to selective supply hydraulic fluid to the control valve 2303 and the actuator piston bore 2302 of the brake housing 2300.

It will be apparent to those skilled in the art that variations and modifications of the present invention can be made without departing from the scope or spirit of the invention.

What is claimed is:

1. A system for actuating an engine valve comprising:
- a cylinder head having a hydraulic fluid supply passage;
- a lost motion housing having a collar surrounding the rocker shaft, an actuator piston bore, and an internal hydraulic circuit extending from the actuator piston bore to the hydraulic fluid supply passage;
- means for securing the lost motion housing in a fixed position relative to the rocker shaft; and
- an actuator piston slidably disposed in the actuator piston bore.

2. The system of claim 1 further comprising:
- a control valve bore provided in the lost motion housing, said control valve bore communicating with the internal hydraulic circuit; and
- a control valve disposed in the control valve bore.

3. The system of claim 1 further comprising a solenoid valve adapted to control the supply of hydraulic fluid to said hydraulic fluid supply passage.

4. The system of claim 1 wherein the actuator piston further comprises:
- a hollow interior;
- an adjustable depth lash adjustment screw-plunger partially disposed in said hollow interior and extending out of the top of the actuator piston bore, said screw-plunger having a lower plunger end;
- a retaining collar disposed in said hollow interior above said lower plunger end; and
- a spring disposed between the retaining collar and the lower plunger end.

5. The system of claim 1 wherein the lost motion housing also serves as a rocker shaft pedestal.

6. The system of claim 5, further comprising a solenoid valve mounted on the rocker shaft pedestal, said solenoid valve adapted to control the supply of hydraulic fluid between the hydraulic fluid supply and the actuator piston bore.

7. The system of claim 5 further comprising a solenoid valve mounted on the cam cap, said solenoid valve adapted to control the supply of hydraulic fluid between the hydraulic fluid supply and the actuator piston bore.

8. The system of claim 5 wherein the means for securing the lost motion system in a fixed position comprises one or more bolts extending through the rocker shaft pedestal.

9. The system of claim 1 further comprising a cam cap having a hydraulic passage communicating with the cylinder head hydraulic fluid supply passage.

10. The system of claim 9 further comprising a solenoid valve mounted on the cam cap, said solenoid valve adapted to control the supply of hydraulic fluid to said actuator piston bore.

11. The system of claim 10 further comprising:
- a control valve bore provided in the lost motion housing, said control valve bore communicating with the internal hydraulic circuit; and
- a control valve disposed in the control valve bore.

12. An engine braking system for actuating an engine valve comprising:
- a hydraulic fluid supply;
- a cam cap having a first hydraulic passage communicating with the hydraulic fluid supply;
- a cylinder head having a second hydraulic passage communicating with the first hydraulic passage;
- a fixed position lost motion housing having a collar surrounding the rocker shaft, an actuator piston bore, and an internal hydraulic circuit extending from the actuator piston bore to the second hydraulic passage;
- means for securing the lost motion housing in a fixed position relative to the rocker shaft; and
- an actuator piston slidably disposed in the actuator piston bore.

13. The system of claim 12 further comprising:
- a control valve bore provided in the lost motion housing, said control valve bore communicating with the internal hydraulic circuit; and
- a control valve disposed in the control valve bore.

14. The system of claim 13 further comprising a solenoid valve mounted on the cam cap, said solenoid valve adapted to control the supply of hydraulic fluid between the hydraulic fluid supply and the actuator piston bore.

15. The system of claim 14 wherein the actuator piston further comprises:
- a hollow interior;
- an adjustable depth lash adjustment screw-plunger partially disposed in said hollow interior and extending out of the top of the actuator piston bore, said screw-plunger having a lower plunger end;
- a retaining collar disposed in said hollow interior above said lower plunger end; and
- a spring disposed between the retaining collar and the lower plunger end.

16. The system of claim 12 further comprising a solenoid valve mounted on the cam cap, said solenoid valve adapted to control the supply of hydraulic fluid between the hydraulic fluid supply and the actuator piston bore.

17. The system of claim 12 wherein the lost motion housing also serves as a rocker shaft pedestal.

18. The system of claim 17, further comprising a solenoid valve mounted on the rocker shaft pedestal, said solenoid valve adapted to control the supply of hydraulic fluid between the hydraulic fluid supply and the actuator piston bore.

19. The system of claim 17 further comprising a solenoid valve mounted on the cam cap, said solenoid valve adapted to control the supply of hydraulic fluid between the hydraulic fluid supply and the actuator piston bore.

20. The system of claim 17 wherein the means for securing the lost motion system in a fixed position comprises one or more bolts extending through the rocker shaft pedestal.

* * * * *